United States Patent [19]

Aleixo

[11] Patent Number: 4,805,357

[45] Date of Patent: Feb. 21, 1989

[54] STRUCTURAL MOLD SYSTEM

[76] Inventor: Vitor C. Aleixo, 125A Nandina St., Philadelphia, Pa. 19116

[21] Appl. No.: 2,086

[22] Filed: Jan. 12, 1987

[51] Int. Cl.[4] ..... E04G 11/00

[52] U.S. Cl. ..... 52/79.1; 52/285; 52/586

[58] Field of Search ..... 52/79.1, 79.5, 79.9, 52/79.13, 285, 287, 286, 586; 403/381

[56] References Cited

U.S. PATENT DOCUMENTS

| | | | |
|---|---|---|---|
| 3,300,931 | 1/1967 | Lutze | 52/309 |
| 3,452,498 | 7/1969 | Kinsey | 52/262 |
| 3,731,447 | 5/1973 | Dawdy | 52/489 |
| 3,753,325 | 8/1973 | Stanley | 52/489 |
| 3,922,764 | 12/1975 | Downing, Jr. | 24/259 |
| 3,986,317 | 10/1976 | Mountz | 52/753 |
| 3,989,397 | 11/1976 | Baker | 52/288 X |
| 3,998,018 | 12/1976 | Hodges | 52/481 |
| 4,022,644 | 5/1977 | Smith, Jr. | 156/79 |
| 4,028,859 | 6/1977 | Bellagamba | 52/393 |
| 4,147,004 | 4/1979 | Day | 52/309.9 |
| 4,223,501 | 9/1980 | DeLozier | 52/309.11 |
| 4,263,765 | 4/1981 | Maloney | 52/405 X |
| 4,391,077 | 7/1983 | Giess | 52/285 |
| 4,400,925 | 8/1983 | Van Loghem et al. | 52/586 |

FOREIGN PATENT DOCUMENTS

| | | | |
|---|---|---|---|
| 1058371 | 7/1979 | Canada | 52/586 |
| 3401768 | 8/1985 | Fed. Rep. of Germany | 52/288 |
| 1332113 | 6/1963 | France | 403/381 |

*Primary Examiner*—J. Karl Bell

*Attorney, Agent, or Firm*—Seidel, Gonda, Lavorgna & Monaco

[57] ABSTRACT

The present invention is directed to a structural mold system for on-site fabrication of units selected from the group consisting of walls, floors, ceilings, roofs and the like. The unit comprises a first planar member and a second planar member. The planar members are parallel. A first joint means is fastened to the first planar member and includes a channel having an elongated slot therethrough. The elongated slot has a width less than a width of the channel. The second joint means is fastened to the second planar member and includes a channel. The channel has an elongated slot therethrough. The slot has a width less than a width of the channel. The first and second joint means are disposed on the respective planar members, such that the channels are parallel and the slots are aligned. A male connector means includes lateral edge portions adapted for sliding and locking engagment with the channels. A web member is integral with the lateral edge portions. A width of the lateral edge portion is less than the width of the channel and greater than the width of the slot. A filler material is placed between the planar members.

16 Claims, 6 Drawing Sheets

STRUCTURAL MOLD SYSTEM

SCOPE OF THE INVENTION

This invention is directed to a structural mold system for on-site fabrication of units such as walls, floors, ceilings, roofs and the like.

BACKGROUND OF THE INVENTION

U.S. Pat. No. 4,223,501 discloses a concrete form. The form comprises first and second sidewall members which are arranged in parallel relationship. The edge portion of the sidewall members are adapted for abutting engagement with adjacent sidewalls. The first and second sidewalls are joined together by a connecting member. The connecting member generally includes a planar web portion having a perpendicular flange along its lateral edge portions. The planar web portion between the flanges has a plurality of openings therethrough. Connecting members are embedded within rib portions formed in the sidewall members.

U.S. Pat. No. 3,998,018 is directed to a wall panel mounting system. In FIGS. 7 and 8, a clip member is fastened to edge portions of wall board panels at divers horizontal positions. The clip member is received by a stud. The stud comprises a web member and lateral edge portions. Each lateral edge portion comprises two connecting members and a projecting flange therebetween. Each connecting member is received in the clip member. The projecting flange is Y-shaped and adapted for bearing engagement with the clip member.

U.S. Pat. No. 3,922,764 is directed to a panel clip. The panel clip supports a panel board on studs thereby allowing random removal of the panel from the studs. The clip includes a leg having protrusions extending into the edge of the panel board and a resilient extension having a snap fit over a panel board supporting flange on the stud.

U.S. Pat. No. 3,753,325 is directed to a demountable wall structure. The structure comprises a stud disposed vertically between the floor and ceiling and having a plurality of orifices or receptacles therein. A series of spring type projections spaced from each other and affixed to the back side of each wall partition are adapted to register with the orifices. The wall is formed by placing the back side of the facing sheet against the studs and pushing the spring like projections into the orifices.

U.S. Pat. No. 3,731,447 is directed to a wall board attachment. The attachment comprises an elongated rigid plastic extrusion. The extrusion is adhered to the backface of gypsum wall board along its verical edges. an elongate tubular portion projects rearwardly and lockingly engages a plurality of spring clips which are clipped onto the two opposite faces of a steel stud.

SUMMARY OF THE INVENTION

The present invention is directed to a structural mold system for on-site fabrication of units selected from the group consisting of walls, floors, ceilings, roofs and the like. The unit comprises a first planar member and a second planar member. The planar members are paralle. A first joint means is fastened to the first planar member and includes a channel having an elongated slot therethrough. The elongated slot has a width less than a width of the channel. The second joint means is fastened to the second planar member and includes a channel. The channel has an elongated slot therethrough.

The slot has a width less than a width of the channel. The first and second joint means are disposed on the respective planar members, such that the channels are parallel and the slots are aligned. A male connector means includes lateral edge portions adapted for sliding and locking engagement with the channels. A web member is integral with the lateral edge portions. A width of the lateral edge portion is less than the width of the channel and greater than the width of the slot.

The structural molding system is intended for on-site fabrication of walls, floors, roofing, ceilings and the like. The molds become integral with or a part of the finished wall, floor, roof or ceiling. The system allows for easy assembly and a high labor efficiency.

This mold system will endure storms, and earthquakes without damage, if properly sized. Furthermore, if the proper filler materials are used, the units can be nonflammable and maintenance free. The mold system may be adapted to accomodate plumbing, electrical installation and/or reinforcing material.

The disclosed structural molding system is particularly useful for the execution of small or medium sized construction projects, and building elements as walls, floors, roofs, ceilings coverings columns and beams and the like.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
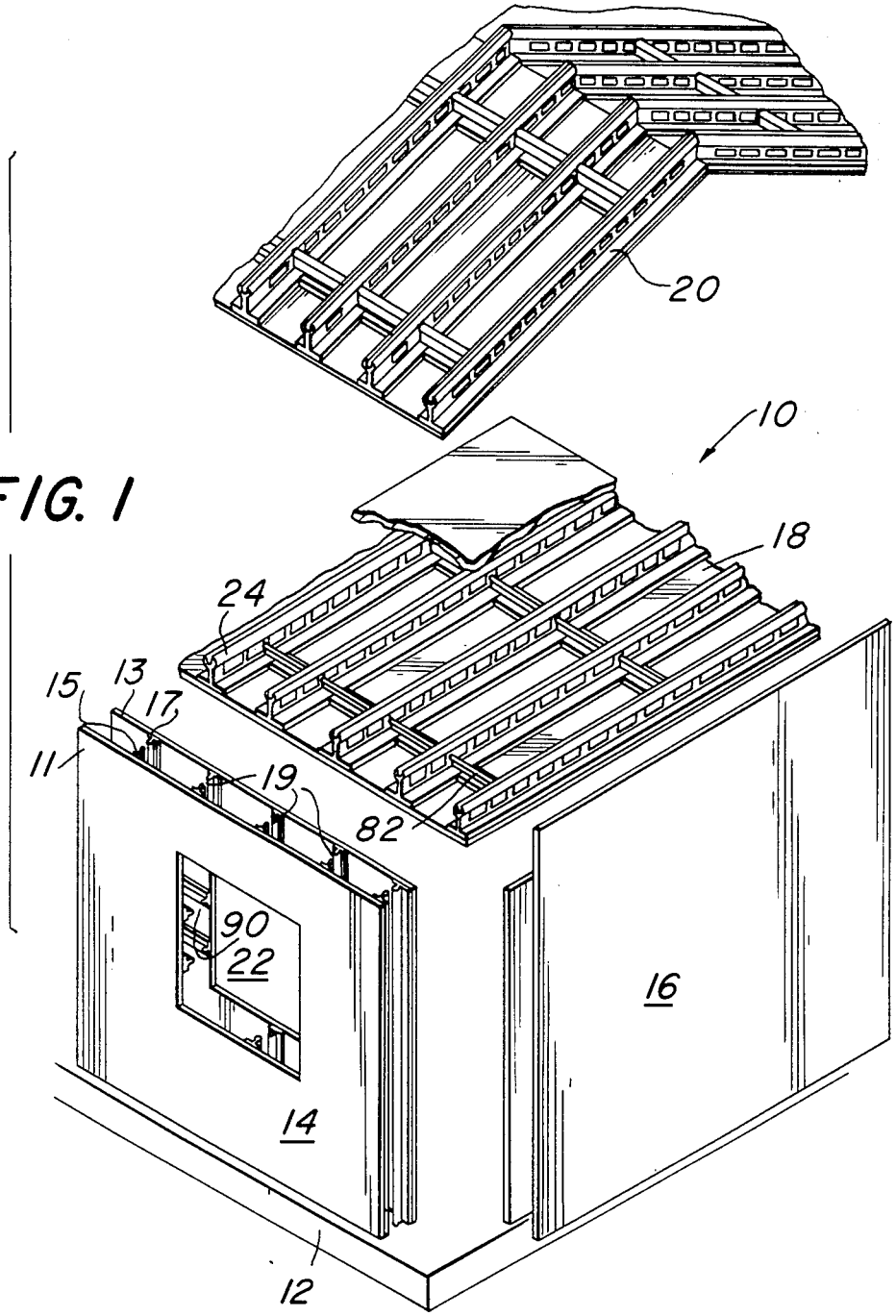
FIG. 1 is an exploded isometric view of a building structure made according to the present invention.

Referring to the drawings wherein like numerals indicate like elements, there is shown a structural mold system 10 for on-site fabrication of units selected from the goup consisting of walls, floors, ceilings, roofs and the like and the elemental components of the system.

Each unit of system 10 includes a first planar member 11 and a second planar member 13. The planar members are in parallel relationship. A first joint means 15 is fastened to first planar member 11. A second joint means 14 is fastened to the second planar member 13. The first and second joint members are disposed on their respective planar members, such that they are parallel to one another. A connector means 19 is adapted for sliding and locking engagement with the joint means. A filler material (not shown) may be placed between the planar members. The specifics of the components mentioned above are discussed in greater detail below.

Referring to FIG. 1, there is shown an isometric view of a portion of a building having units made of the structural mold system described herein. Exterior vertical molds 14 and 16 are mounted adjacent a footer 12. Mold 14 has an opening 22 therethrough. The open edges of the mold may be sealed closed in any manner to enclose the mold. Mold 16 has an exterior planar member which has a height greater than the interior planar member. Ceiling mold 18 and roof mold 20 are shown with parts broken away for clarity. The constituent elements and assembly of the molds will be described in detail below.

Figure 2:
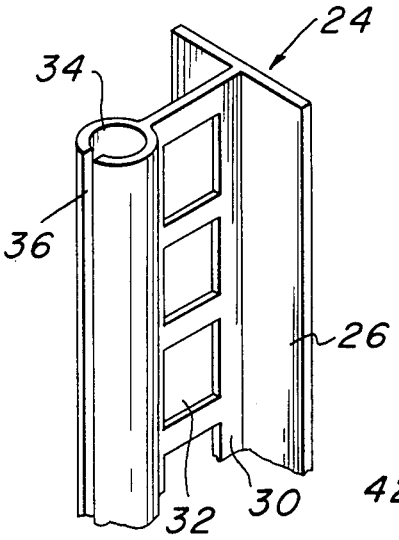
FIG. 2 is an isometric view of a brace member.

Brace member 24 (FIG. 2) is the principal joint of the herein described structural molding system 10. In the vertical molds;the brace member 24 is vertically placed within the mold. The brace member 24 comprises a flange 26 adapted for fastening to planar member 28. The "fastening" described hereinafter refers to any conventional fastening means including but not limited to gluing, stapling, nailing, etc. Flange 26 is generally parallel to the planar member. A web 30 is perpendicular to and integral with flane 26. Preferably, web 30 includes a plurality of openings 32 therethrough. A channel 34 is disposed at an end of the web 30 opposite the flange 26 and is integral therewith. Channel 34 is preferably circular in cross section and includes an elongated slot 36 therethrough. The width of the slot 36 is less than the diameter (or width) of the channel 34. Slot 36 of the brace 24 is in a plane generally parallel to the plane of flange 26. Preferably, brae member 24 is an integral member and is made of any extrudable material such as but not limited to thermoplastics, aluminum, steel or iron.

Figure 3:
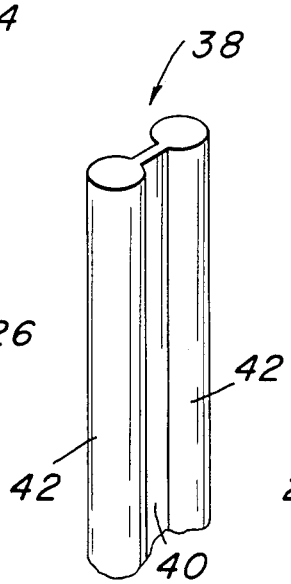
FIG. 3 is an isometric view of a male connector member of the present invention.
Figure 4:
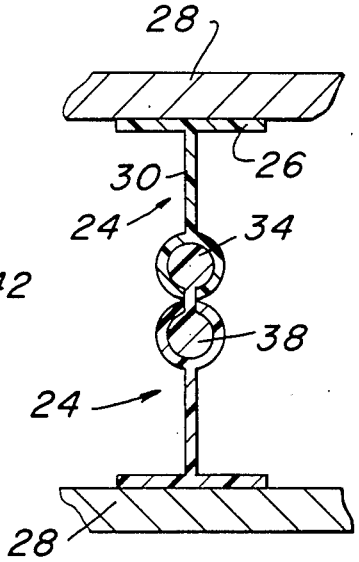
FIG. 4 is a cross sectional view illustrating two brace members joined by a male connector member.

A second brace 24 is fastened to the second planar member such that the elongated slot 36 of the respective channels 34 are parallel to and aligned with one another (FIG. 4). A male connector member 38 (FIG. 3) is adapted for sliding and locking engagement with the channels 34 of the respective brace members 24. The male connector member 38 generally comprises a web 40 preferably having cylindrical bead member 42 disposed along the lateral edge portions of the web 40. Web 40 can have varying widths (i.e. from lateral edge to lateral edge). The width of web 40 is based upon the thickness of the unit desired. The thickness of web 40 is less than the width of slot 36, so that web 40 can freely slide into the slots. The diameter (or width) of bead member 42 is less than the diameter of channel 34 but greater than the width of slot 36, whereby the connector member can be locked into the brace 24. This locking feature prevents the planar members from separating when a filler material is introduced therebetween. Preferably, member 38 is an integral member and is made of an extrudable material such as but not limited to thermoplastics, aluminum, steel or iron.

Figure 5:
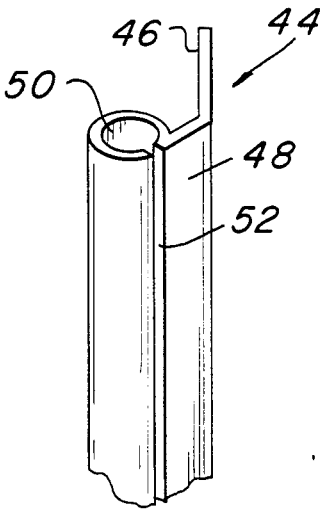
FIG. 5 is an isometric view of an inside corner member.
Figure 6:
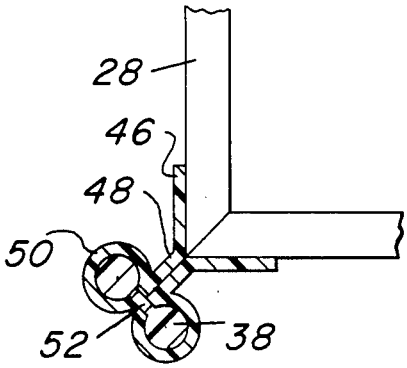
FIG. 6 is a cross sectional view of two inside corner members joined by a male connector member.

Inside corner members 44 (FIG. 5) are provided to join planar members, so that the planar members will not separate at corners. The inside corner member 44 generally comprises a flange member 46 which is generally parallel to the planar member 28 and adapted for fastening thereto. A web member 48 is integral with flange member 46 and is placed at an angle of 135° (an obtuse angle) from the plane of the flange member 46. It will be understood by those of ordinary skill that the 135° angle will provide a 90° corner. Other angles of the flange to web and of the corner are possible. A channel member 50 is substantially the same as the above described channel member 34 and is integral with web 48 (i.e. the channel 50 preferably has a circular cross-section and an elongated slot 52 having a width less than the diameter of the channel 50). The elongated slot 52 of channel 50 is coplanar with web 48. Inside corner member 44 is fastened to respective planar members such that elongated slots 52 are juxtaposed to one another. A connecting member 38 is then slid into the respective channels 50 thereby joining the inside corner member 44 together (FIG. 6).

Figure 7:
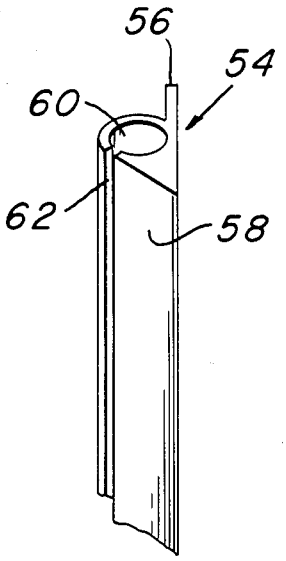
FIG. 7 is an isometric view of an outside corner member.
Figure 8:
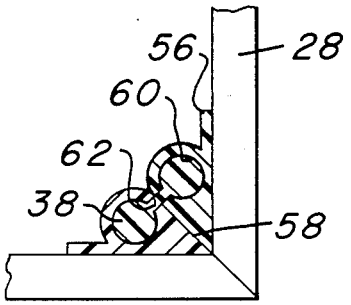
FIG. 8 is a cross sectional view of two inside corner members joinded by a male connector member.

Outside corner members 54 (FIG. 7) are provided for joining planar members at outside corner joints, so that planar members will not separate at corners. Inside corner member 54 includes a flange portion 56 which is generally parallel with the planar member 28 and adapted for fastening thereto. A web plane 58 is at a 45° angle (an acute angle) to the plane defined by flange member 56, so that a 90° corner is formed. Other angles of the flange to web plane and of the corner are possible. A channel member 60 which is generally the same as previously described channel members 34 and 50 (i.e., channel member 60 preferably has a circular cross-section and an elongated slot 62 having a width less than the diameter of the channel 60). The elongated slot 62 is coplanar with web plane 58. When outside corner members 54 are in place, the elongated slots 62 are in face contact. A connecting member 38 can then be slid into the respective channel 60 thereby locking outside corner members 54 together (FIG. 8).

Figure 9:
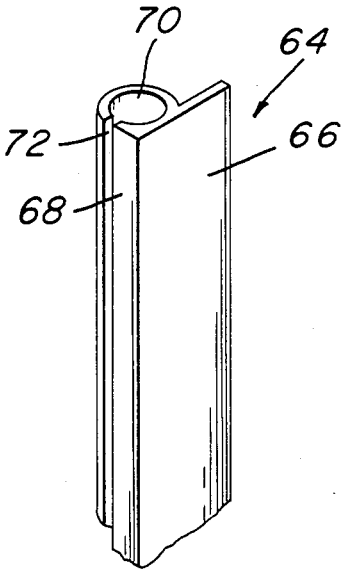
FIG. 9 is an isometric view of a butt wall connector.

Butt wall connectors 64 (FIG. 9) are provided for joining planar members. Butt wall connectors 64 include a flange member 66 for fastening to the planar member 28. A web plane 68 is perpendicular to flange member 66. A channel member 70 is substantially identical to the channel members described above (i.e. channel member 70 preferably has a circular cross-section and an elongated slot 72 having a width less than the diameter of channel 70). The elongated slot 72 is coplanar with the web plane 68.

Figure 10:
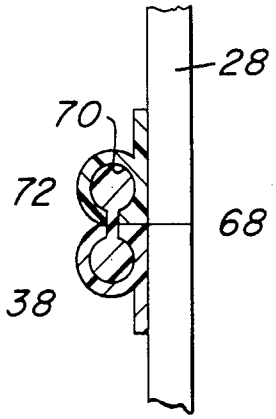
FIG. 10 is a cross sectional view of a two butt wall connector joined by a male connector member.

Butt wall connectors 64 are fastened to the respective planar members and the planar members are brought together, whereby the elongated channels 72 are aligned (FIG. 10). A male connector member 38 may be slid into respective channels 70 thereby locking the butt wall connectors 64 and their respective planar members together.

Figure 11:
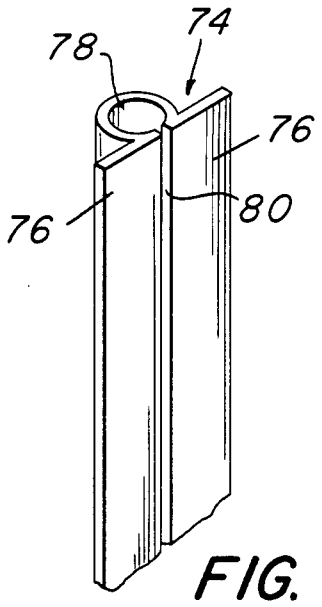
FIG. 11 is an isometric view of a midmold connector.

Midmold connector 74 (FIG. 11) is provided for forming a joint when a first mold section meets a perpendicular mold section intermediate the ends of the first mold. Midmold connector 74 comprises flange sections 76 which are adapted for fastening to a planar member 28. A channel member 78 which is substantially the same as the previously described channel members (i.e., the channel member 78 preferably has a circular cross section and an elongated slot 80 having a width less then the diameter of the channel 78). The elongated slot 80 is in the plane of the flange mebmers 76.

Figure 12:
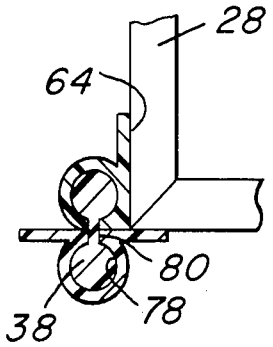
FIG. 12 is a cross sectional view of a midmold connector joined to a butt wall connector by a male connector member.

Preferably, midmold connector 74 is adapted for use with butt wall connector 64 (FIG. 12). Of course,those of ordinary skill in the art will readily appreciate that midmold connector 74 may be used with any of the previously described connector means.

Figure 13:
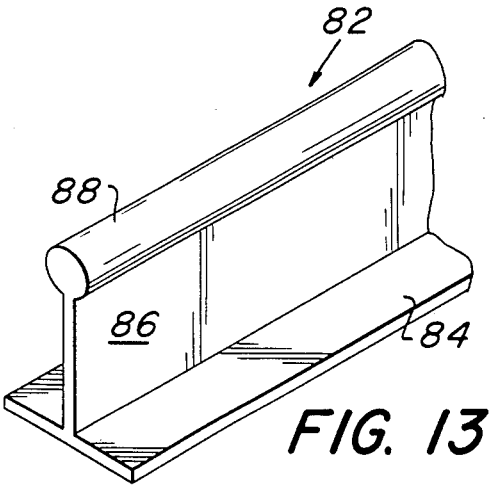
FIG. 13 is an isometric view of an orthogonal brace.
Figure 14:
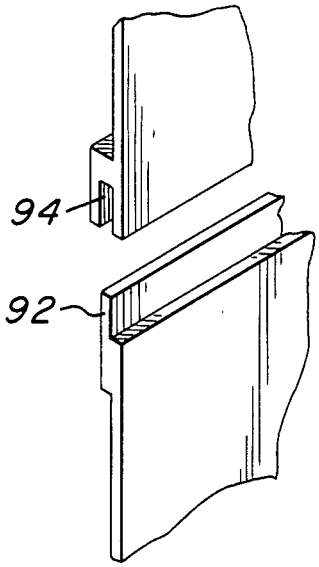
FIG. 14 is an exploded view of a tongue-in-groove joint.
Figure 15:
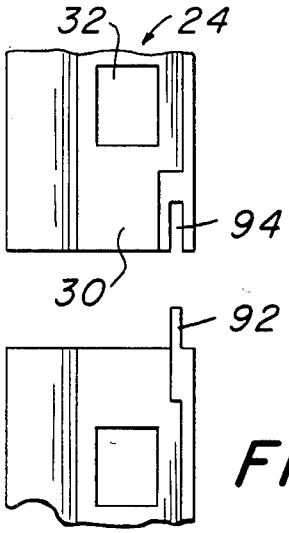
FIG. 15 is an exploded cross sectional view of a tongue-in-groove joint.

Orthogonal brace 82 is provided for giving the construction unit stiffness at riht angles to the brace member 24 (FIG. 1). Brace 82 comprises a flange member 84 which is fastened to the planar member (FIG. 13). A web member 86 is perpendicular to and integral with flange member 84. A beaded member 88 is disposed at the end web 86 and is integral therewith. Preferably the beaded member 88 is cylindrical. Web 86 has a width less (bead to flange) than the web 30 of the brace member 24. It is preferred that the web 86 has a width less than web 30 of the brace member 24 whereby a space 90 is formed between respective braces 82 when a mold unit is assembled (FIG. 1).

Planar members may be joined together by a tongue-in-groove joint. Tongue 92 is adapted for receipt within a groove 94. The tongue-in-groove joint is provided for joining together planar wall members along an extended planar surface.

Figure 16:
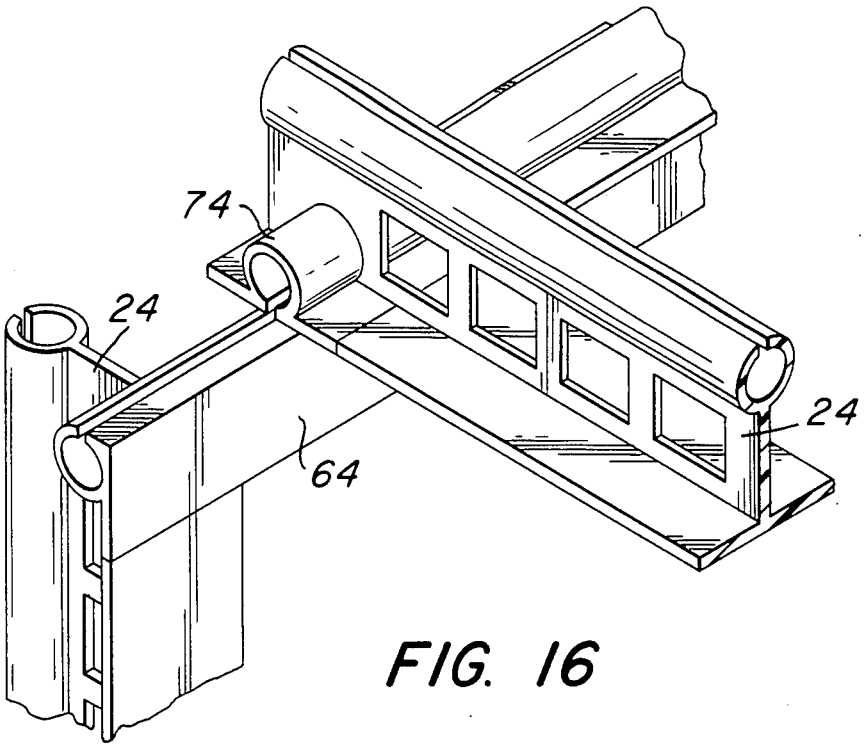
FIG. 16 is an isometriv view of a wall unit to ceiling unit joint.
Figure 17:
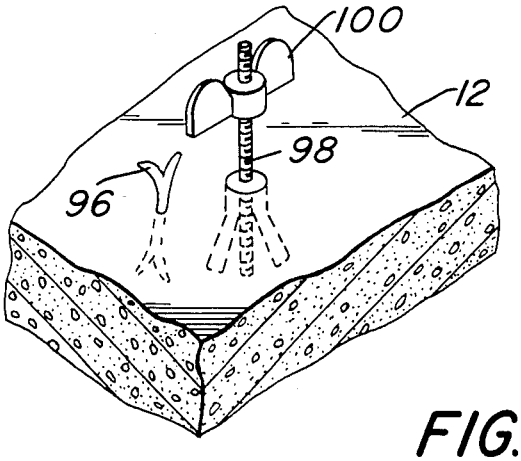
FIG. 17 is an isometric view of anchors.

The above described members and connectors may be utilized to provide a plurality of different joints. Specifically, the joint connecting a planar member of a lateral vertical wall mold with a planar member of a horizontal ceiling mold is illustrated (FIG. 16). Butt wall connector 64 is provided along the upper edge portion of the lateral vertical wallmold. A midmold connector 74 has been joined with a brace member 24. A male connector 38 (not shown) is then slid within the respective channels of the butt wall and midmold connectors thereby locking the wall and ceiling molds together.

As is now evident from the above disclosure,the various members and connectors can be combined in numerous ways to fabricate any needed unit. For example, the tongue-in-groove joints or butt wall connectors can be used to extend units in either horizontal or vertical directions. The inside and outside corner members can be used to form any corners. Furthermore, if the units are assembled separately and then joined together they can be readily assembled and disassembled.

Anchors are provided for securing lateral wall molds to footers. Preferably, anchors 96 is Y-shaped at both ends. One end is embedded in the footer 12 and the second end extends above the footer. Additionally, a threaded member 98 having a wingnut 100 may also serve as an anchor.

Figure 18:
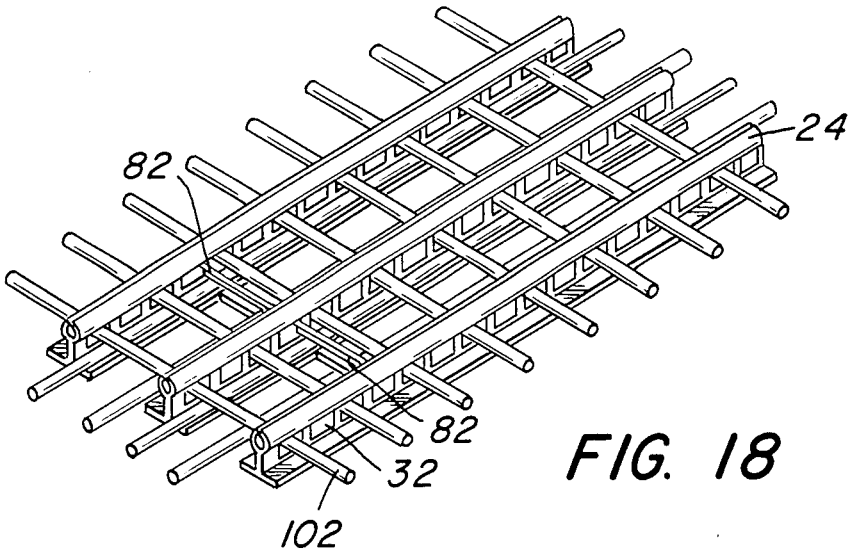
FIG. 18 is an isometric view of reenforcement member intertwined with the brace member.
Figure 19:
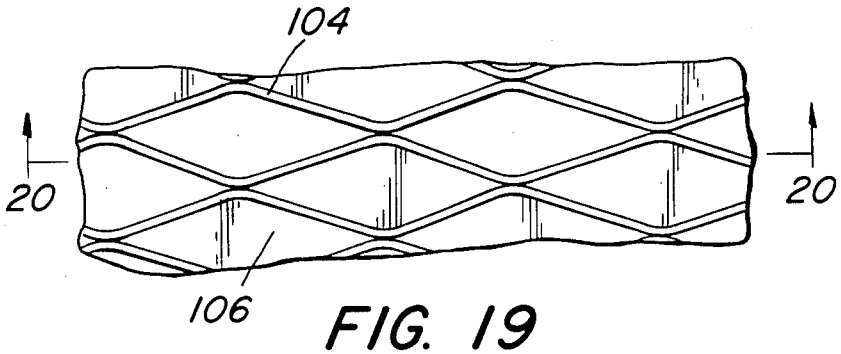
FIG. 19 is a planar view of a wire mesh.
Figure 20:
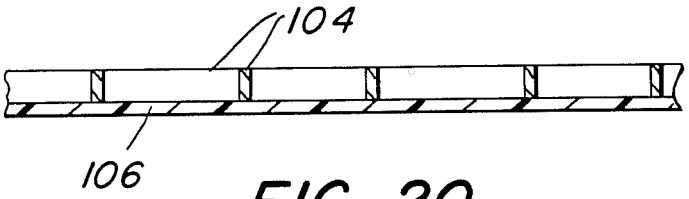
FIG. 20 is a cross sectional view of a planar member.

Preferably brace members 24 has apertures 32 in webs 30 through which may pass reinforcing members 102 (FIG. 18) or plumbing or electrical materials (not shown, but which ar well known in the art). Such materials pass through apertures 32 of vertical braces 24 or within gaps 90 defined by braces 82.

The planar members may be of any structure which is well known to those skilled in the art. However, it is preferred that a wire mesh 104 be provided between the flange member of the various members or connectors described above and the planar member 106. The wire mesh is provided to improve the strength of the unit and for improved adhesion of filler material,discussed below, to the mold.

After a construction unit is assembled, a filler material is preferably pumped within the space betwen planar members. The filler material may comprise foam, concrete, cellular concrete, plastic foam or insulating materials,,the choice being left to the ultimate user.

An alternate embodiment of the present invention involves the fabrication of units without the use of braces 24. The space between the planar members is filled with the filler material and the other various (all but the braces 24) connectors are used for joining the units together.

The present invention may be embodied in other specific forms without departing from the spirit or essential attributes thereof and, accordingly, reference should be made to the appended claims, rather than to the foregoing specification, as indicating the scope of the invention.

I claim:

1. In a structural mold system for on-site fabrication of units selected from the group consisting of walls, floors, ceilings, roofs and the like, the unit comprising:

a first planar member;

a second planar member, said first and second planar members being parallel;

a first joint means being fastened to said first planar member and including a flange member being parallel to said first planar member, a web member being perpendicular to said flange member, and a channel having an elongated slot therethrough, said slot having a width less than a width of said channel, said channel being disposed at an end of said web member opposite said flange;

a second joint means being fastened to said second planar member and including a flange member being parallel to said second planar member, a web member being perpendicular to said flange member, and a channel having an elongated slot therethrough, said slot having a width less than a width of said channel, said channel being disposed at an end of said web member opposite said flange, said first and second joint means being disposed on said respective planar members, such that said channels are parallel and said slots are aligned; and male connector means for sliding and locking engagement with said channels, said male connector means including lateral edge portions and a web member being integral with said lateral edge portions, a width of said lateral edge portions being less than said width of said channel and greater than said width of said slot.

2. The system according to claim 1 further comprising a filler material being disposed within a cavity defined between said first and second planar members.

3. The system according to claim 1 includes said web member having a plurality of apertures therethrough.

4. The system according to claim 1 wherein said web member of saidmale connector means has a thickness less than the width of said slots.

5. The system according to claim 1 further comprising an orthogonal brace member including a flange member being parallel to said planar member, a web member being perpendicular to and integral with said flange member, said web member having a width less than a width of said web member of said joint means, and a bead member being located at an end of said web member opposite said flange member and being integral therewith.

6. The system according to claim 1 further comprising an inside corner member including a flange member being parallel to said planar member, a web member being at an obtuse angle to and integral with said flange member and a channel member having an elongated slot therethrough, said slot having a width less than a width of said channel, said slot being coplanar with said web member, and said channel member being integral with said web member.

7. The system according to claim 1 further comprising an outside corner member, including a flange member being parallel to said planar member, a web plane being at an acute angle to said flange member, and a channel member having an elongated slot therethrough, said slot having a width less than a width of said channel member, said channel being integral with said flange member and said slot being coplanar with said web plane.

8. The system according to claim 1 further comprising a butt wall connector including a flange member being parallel to said planar member, a web plane being perpendicular to said flange member, and a channel member being integral with said flane member, said channel member having an elongated slot therethrough, said slot being coplanar with said web plane and having a width less than a width of said channel.

9. The system according to claim 1 further comprising a midmold connector including a flange member being parallel to said planar member, and a channel member being integral with said flange member, said channel member having an elongated slot therethrough, said slot being coplanar with said flange member and having a width less than a wisth of said channel.

10. The system according to claim 3 wherein reinforcing members pass through said apertures.

11. The system according to claim 1 including said channel having a circular cross-section.

12. The system according to claim 1 wherein said planar members include a wire mesh and an exterior panel, said mesh being disposed between said joint means and said panel.

13. In a structural building system for on-site fabrication of buildings having units selected from the group consisting of walls, floors, ceilings, roofs and the like, each unit having at least one planar member, a joint for joining the units comprising:

a first inside corner member including a flange member being parallel to the planar member of the first unit, a web member being at an obtuse angle to and integral with said flange member and a channel member having an elongated slot therethrough, said slot having a width less than a width of said channel, said slot being coplanar with said web member, and said channel member being integal with said web member;

a second inside corner member including a flange member being parallel to the planar member of the second unit, a web member being at an obtuse angle to and integral with said flange member and a channel member having an elongated slot therethrough, said slot having a width less than a width of said channel, said slot being coplanar with said web member, and said channel member being integral with said web member; and male connector means for sliding and locking engagement with said channels of both said members and for holding said web members in face-to-face contact, said male connector means including lateral edge portions and a web member being integral with said lateral edge portions, a width of thelateral edge portion being less than said width of said channel and greater than said width of said slot.

14. In a structural building system for on-site fabrication of buildings having units selected from the group consisting of walls, floors, ceilings, roofs and the like, eachunit having at least one planar member, a joint for joining the unit comprising:

a first outside corner member including a flange member being parallel to the planar member of the first unit, a web plane being at an acute angle to said flange member, and a channel member having an elongated slot therethrough, said slot having a width less than a width of said channel member, said channel being integral with said flange member and said slot being coplanar with said web plane;

a second outside corner member including a flange member being parallel to the planar member of the second unit, a web plane being at an acute angle to said flange member, and a channel member having an elongated slot therethrough, said slot having a width less than a width of said channel member, said channel being integral with said flange member and said slot being coplanar with said web plane; and male connector, means for sliding and locking engagement with said channels of both said members and for holding said web planes in face-to-face contact, said male connector means including lateral edge portions and a web member being integral with said lateral edge portions, a width of the lateral edge portion being less than said width of said channel and greater than said width of said slot.

15. In a structural building system for on-site fabrication of buildings having units selected from the group consisting of walls, floors, ceilings, roofs and the like, each unit having at least one planar member, a joint for joining these units comprising:

a butt wall connector including a flange member being parallel to the planar member of the first unti, a web plane being perpendicular to said flange member,and a channel member being integral with said flange member, said channel member having an elongated slot therethrough, said slot being coplanar with said web plane and having a width less than the width of said channel;

a midmold connector including a flange member being parallel to the planar member of the second unit, and a channel member being integral with said flange member, said channel member having an elongated slot therethrough, said slot being coplanar with said flange member and having a width less than the width of said channel; and male connector means for sliding and locking engagement with said channels for both said connectors and for holding said web plane inclose contact with said midmold connector, said male connector means including lateral edge portions and a web member being integral with said lateral edge portions, a width of said lateral edge portion being less than said width of said channel and greater than said width of said slot.

16. In a structural building system for on-site fabrication of buildings having units selected from the group consisting of walls, floors, ceilings, roofs and the like, each unit having at last one planar member, a joint for joining the units comprising:

a first corner member including a flange member being parallel to the planar member of the first unit, a web plane being at an angle to said flange member, and a channel member having an elongated slot therethrough, said slot having a width less than a width of said channel member, said channel being integral with said flange member and said slot being coplanar with said web plane;

a second corner member including a flange member being parallel to the planar member of the second unit, a web plane being at an angle to said flange member, and a channel member having an elongated slot therethrough, said slot having a width less than the width of said channel member, said channel being integral with said flange member and said slot being coplanar with said web; and male connector means for sliding and locking engagement with said channels of both said members and for holding said web planes in face-to-face contact, said male connector means including lateral edge portions and a web member integral with said lateral edge portions, a width of said lateral edge portion being less than said width of said channel and greater than said width of said slot.

* * * * *